US005673435A

United States Patent [19]

Gebhard

[11] Patent Number: 5,673,435

[45] Date of Patent: Oct. 7, 1997

[54] CLEANING GLOVE

[76] Inventor: Albert W. Gebhard, 2101 E. Alameda, Denver, Colo. 80209

[21] Appl. No.: 532,895

[22] Filed: Sep. 22, 1995

[51] Int. Cl.[6] ..... A41D 19/00

[52] U.S. Cl. ..... 2/159; 2/161.6; 2/162

[58] Field of Search ..... 2/158, 159, 161.6, 2/162, 167, 16, 20, 161.8, 165; 15/227; 66/172 E, 200, 197

[56] References Cited

U.S. PATENT DOCUMENTS

| | | | |
|---|---|---|---|
| 753,000 | 2/1904 | Phillips | 2/162 |
| 782,920 | 2/1905 | Oullette | 2/158 |
| 1,215,163 | 2/1917 | Johnson | 2/158 |
| 1,507,707 | 9/1924 | Morganstern | 15/227 |
| 1,612,757 | 12/1927 | Wells | 2/162 |
| 1,791,580 | 2/1931 | Stokes | 2/159 |
| 1,791,581 | 2/1931 | Stokes | 2/159 |
| 2,101,027 | 12/1937 | Karger | 15/227 |
| 2,124,721 | 7/1938 | Wagner | 2/162 |
| 2,283,585 | 5/1942 | Smith, Jr. | 66/172 E |
| 2,306,914 | 12/1942 | Smith, Jr. | 66/172 E |
| 2,337,211 | 12/1943 | St. Pierre | 66/172 E |
| 2,505,409 | 4/1950 | Kirchner | 2/158 |
| 2,569,067 | 9/1951 | Livshin | 15/227 |
| 3,327,320 | 6/1967 | Forsyth | 2/158 |
| 3,739,400 | 6/1973 | Colehower | 2/161.6 |
| 3,885,249 | 5/1975 | De Brabander | 2/161 R |
| 4,330,887 | 5/1982 | White | 2/16 |
| 4,523,348 | 6/1985 | Petrie | 2/158 |
| 4,825,499 | 5/1989 | Baptiste | 2/167 |

*Primary Examiner*—Amy B. Vanatta
*Attorney, Agent, or Firm*—John E. Reilly

[57] ABSTRACT

A cleaning glove specifically adaptable for bathing infants is made up of a single layer of fine terry cloth material to define the palmar, back, finger and thumb portions together with an elastic cuff joined to said palmar and back portions to define a wrist portion, the cuff being ribbed and sized to prevent accidental removal of the glove from the hand when wet.

3 Claims, 1 Drawing Sheet

CLEANING GLOVE

BACKGROUND AND FIELD OF INVENTION

This invention relates to gloves; and more particularly to novel and improved terry cloth gloves to be worn on the hands in the bathing of infants or cleaning of various articles.

It has been proposed to provide terry cloth gloves for cleaning infants and, for example, reference is made to U.S. Pat. No. 4,330,887 for TERRY CLOTH GLOVES. The gloves of the '887 patent are long-sleeved gloves which cover the forearm and upper arm of the user and are provided with a separate, adjustable VELCRO™ band to wrap around the upper entrance end of the sleeve portion of the glove in order to secure the glove to the upper arm and prevent slippage. When the gloves and hands become wet, owing to the amount and absorbency of the material, there is even more of a tendency for the gloves to slip off of the hands. Other representative patents of interest are U.S. Pat. Nos. 3,327,320 to S. P. Forsyth and 3,885,249 to J. L. De Brabander.

It has been found that it is possible to avoid the necessity of long-sleeved gloves in order to secure the gloves to the hands and in fact to provide gloves which cover only the hands but can be secured in such a way that the gloves will not tend to slip from the hands when wet. Of additional importance is to construct the gloves of a fine terry cloth material which is characterized by high water absorbency but extremely thin so that the user can retain the necessary feel and pressure when bathing an infant. Moreover, it is desirable that the gloves be multi-purpose and capable of being used in other cleaning functions, such as, dusting or the cleaning of counters, furniture and plants.

SUMMARY OF THE INVENTION

It is therefore an object of the present invention to provide for novel and improved terry cloth gloves wherein the gloves can be securely retained on the hands when wet and avoid any tendency to slip off of the hands.

It is another object of the present invention to provide for cleaning gloves composed of a fine terry cloth material and which are extremely thin and of one-piece construction.

Another object of the present invention is to provide for cleaning gloves which can be quickly but securely placed on the hands and retained on the hand without special attachments but can be positively but rapidly removed when desired.

It is a further object to provide in a cleaning glove having a terry cloth material possessing high water absorbency and good frictional or gripping characteristics with a novel and improved rubberized cuff for securely retaining the gloves on the hands even when wet.

In accordance with the present invention, a one-piece cleaning glove is made up of front, back, finger and thumb portions composed of a single layer of fine terry cloth material possessing high water absorbency, and an elastic cuff is joined to the front and back portions at the wrist, the cuff being of an elastic material and sized to prevent accidental removal of the glove from the hand when the glove is wet. Preferably, the elastic cuff is formed of a fabric ribbed material which is rubberized or otherwise given sufficient elasticity as to firmly but yieldingly contract around the wrist portion of the hand.

The above and other objects of the present invention will become more readily appreciated and understood from a consideration of the following detailed description of a preferred embodiment of the present invention when taken together with the accompanying drawings in which:

DETAILED DESCRIPTION OF PREFERRED EMBODIMENT

Figure 1:
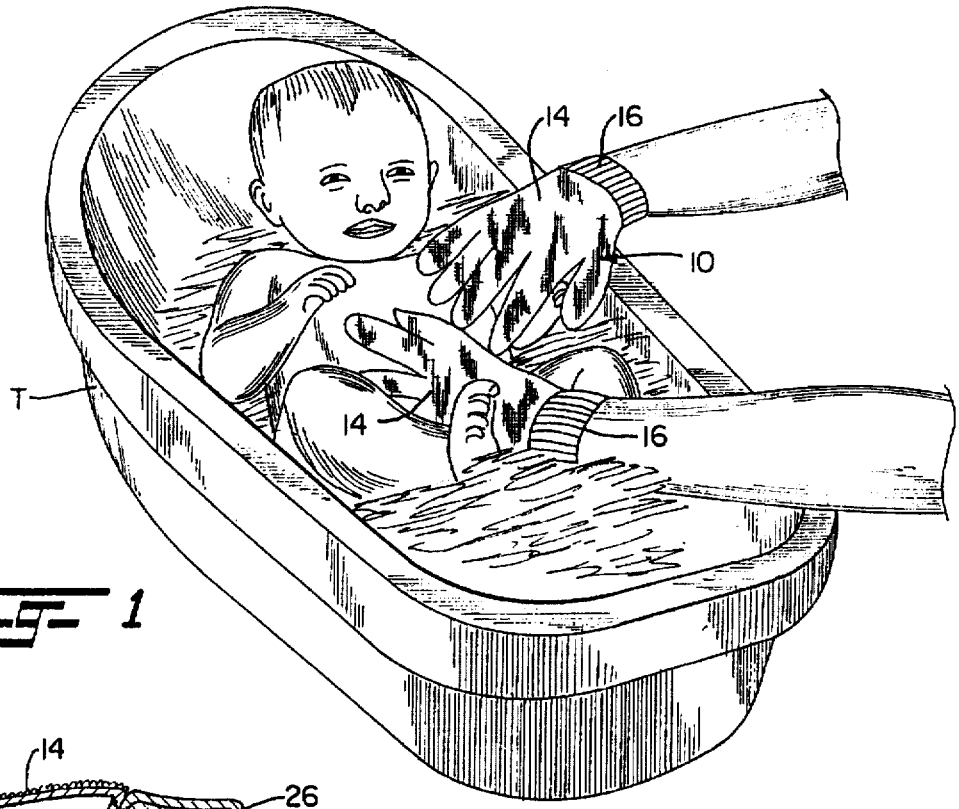
FIG. 1 is a perspective view illustrating a preferred form of cleaning gloves in accordance with the present invention.
Figure 2:
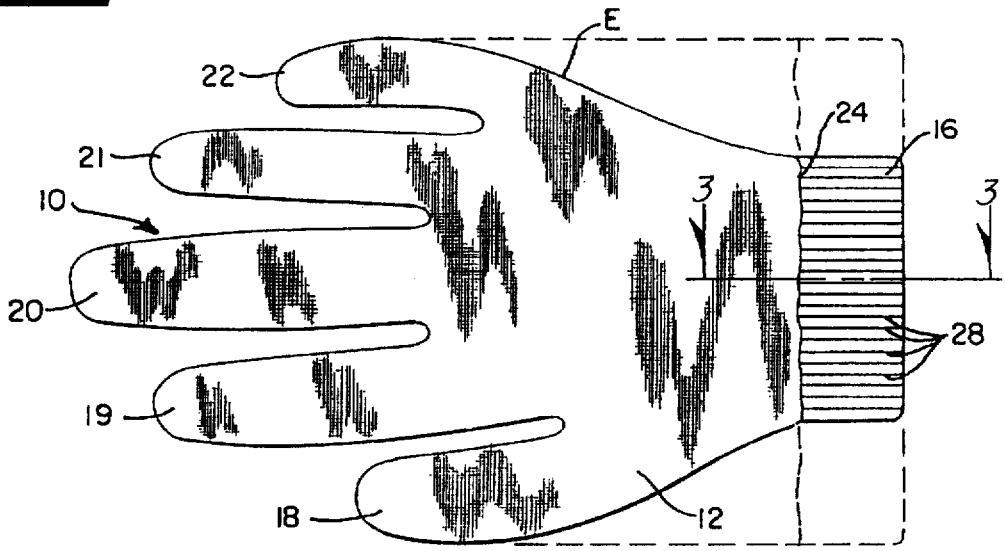
FIG. 2 is a somewhat plan view of a preferred form of cleaning glove in accordance with the present invention.

Referring in more detail to the drawings, a single cleaning glove 10 is illustrated in FIG. 2, and a pair of identical cleaning gloves 10 are illustrated in FIG. 1 for the left and right hands of an adult in bathing an infant in a tub T. The preferred form of cleaning glove 10 is comprised of a palmar or front portion 12, back portion 14 and wrist portion 16. A thumb portion 18 along with a series of finger portions 19, 20, 21 and 22 form continuations of the palmar and back portions 12 and 14.

Each cleaning glove 10 is constructed by cutting outlines which are slightly oversized with respect to the size of the hand intended to fit the glove and seaming together a pair of outlines along adjoining edges generally designated at E between the palmar and back portions 12 and 14 and at F between the thumb portion 18 and finger portions 19–22. Thus, each side or outline of a glove is composed of a single ply of terry cloth material and is preferably a fine grade material having a tight fabric loop and possessing a high water absorbency rate. The single ply of terry cloth is characterized by having a smooth surface and an opposite, pile or fabric looped surface; and when seamed together the smooth surface will be on the interior of the glove and the rough surface on the exterior to facilitate grasping of objects without slipping.

Figure 3:
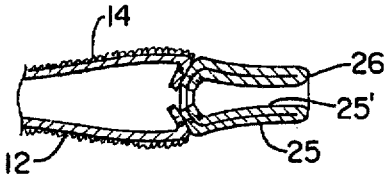
FIG. 3 is a sectional view taken about lines 3—3 of FIG. 2.

The elastic cuff 16 is seamed to an entrance end 24 of each glove. The cuff 16 is in the form of an endless or closed band of material having sufficient resiliency that it can expand to slide over the hand but will then contract snugly into firm-fitting engagement with the wrist portion. Preferably, the cuff is fabricated of multiple plies of a fabric ribbed material which is composed at least in part of LYCRA® or Spandex threads or other rubber or rubber-like material interspersed with cotton fibers throughout the cuff. As best seen from FIGS. 2 and 3, the cuff is formed of a single ply of fabric ribbed material which is doubled upon itself to form two layers or plies 25 and 25' which are seamed together at their free ends to the entrance end 24 and have an opposite closed end 26. Ribs 28 are normally contracted into closely spaced relation to one another as represented in FIG. 3 and extend in a direction lengthwise of the glove, or parallel to the fingers so that the stretching or expansion of the glove is in a circumferential direction along the cuff 16. The ribbing when combined with the elasticity of the cuff is such as to permit expansion to a size approximately twice the normal opening size.

In the preferred form, the glove 10 is made to be reversible so as to fit on either hand. Thus, the palmar portion 12 and back portion 14 are interchangeable depending upon their being placed either on the left hand or right hand.

The cleaning glove of the present invention is extremely useful in performing a number of cleaning functions in addition to bathing infants or cleaning other delicate articles. Most importantly, however, the terry cloth material is soft but has sufficient friction or gripping properties to enable grasping of an infant without slipping, and the elastic cuff will counteract any tendency of the glove to slide or slip off the hands. The gloves can also be used in dusting or cleaning the leaves of plants as well as other household uses and are particularly effective in cleaning the leaves of plants owing to the frictional properties of the terry cloth wherein each finger can be used to grasp or clean.

While a preferred form of invention is herein set forth and described, it will be apparent that various modifications and changes may be made therein without departing from the spirit and scope of the present invention as defined by the appended claims and reasonable equivalents thereof.

I claim:

1. A one-piece infant bathing glove (10) comprising palmar (12), back (14), finger and thumb portions (19–22) composed of a single layer of fine terry cloth material possessing high water absorbency, and an elastic cuff (16) defining a wrist portion permanently joined to said palmar and back portions, said cuff adapted to encircle the wrist portion of a user and sized to prevent accidental removal of said glove from the hand when the glove is wet, said elastic cuff being composed of a double ply of fabric material including ribs (28) extending in a direction lengthwise of said glove and being interspersed with elastic threads of rubber or rubber-like material and fibers to define said cuff.

2. A bathing glove according to claim 1, said wrist portion having a relaxed opening size of approximately one-half its expanded opening size.

3. A bathing glove according to claim 2, said palmar, back, finger and thumb portions having a smooth inner surface and pile-like exterior surface.

* * * * *